US007103308B2

(12) United States Patent
Wakana

(10) Patent No.: US 7,103,308 B2
(45) Date of Patent: Sep. 5, 2006

(54) DEVELOPER CARTRIDGE AND IMAGE FORMING APPARATUS

(75) Inventor: Takashi Wakana, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/090,305

(22) Filed: Mar. 28, 2005

(65) Prior Publication Data

US 2005/0220515 A1 Oct. 6, 2005

(30) Foreign Application Priority Data

Apr. 1, 2004 (JP) ..... 2004-109008
Jun. 29, 2004 (JP) ..... 2004-191907

(51) Int. Cl.
*G03G 21/00* (2006.01)

(52) U.S. Cl. ..... 399/358; 399/360; 399/120

(58) Field of Classification Search ..... 399/360, 399/120, 358
See application file for complete search history.

(56) References Cited

U.S. PATENT DOCUMENTS 5,617,195 A * 4/1997 Torimaru et al. ..... 399/358
6,466,763 B1 * 10/2002 Campbell et al. ..... 399/360

FOREIGN PATENT DOCUMENTS

| | | |
|---|---|---|
| JP | 05-094121 | 4/1993 |
| JP | 11-174917 | 7/1999 |
| JP | 2000-181224 | 6/2000 |

* cited by examiner

*Primary Examiner*—David M. Gray
*Assistant Examiner*—Ruth N. LaBombard
(74) *Attorney, Agent, or Firm*—Rabin & Berdo, P.C.

(57) ABSTRACT

A developer reservoir is detachably attached to an image forming apparatus and holds developer discharged from a developer discharging section of the image forming apparatus. The developer reservoir includes a developer inlet, a developer chamber, and a transport mechanism. The developer inlet receives the developer discharged from the developer discharging section. The developer chamber holds the developer delivered through the developer inlet. The transport mechanism takes the form of a screw conveyor that transports the developer from the developer inlet into the developer chamber. The developer-transporting member serves as a partition that divides the waste toner reservoir into the toner inlet and the toner chamber so that the developer is prevented from moving straight from the developer inlet into the developer chamber.

17 Claims, 13 Drawing Sheets

DEVELOPER CARTRIDGE AND IMAGE FORMING APPARATUS

BACKGROUND OF THE INVENTION

1. Field of the Invention

The present invention relates to a developer cartridge and an image forming apparatus to which the developer cartridge is attached.

2. Description of the Related Art

A conventional image-forming apparatus such as an electrophotographic printer, a copying machine, and a facsimile machine performs an electrophotographic process. A charging roller charges the surface of a photoconductive drum uniformly. An exposing unit illuminates the charged surface of the photoconductive drum to form an electrostatic latent image on the photoconductive drum. A developing roller applies toner to the electrostatic latent image to develop it into a toner image. Then, a transfer roller transfers the toner image onto printing paper. The printing paper is then advanced to a fixing unit where the toner image is fixed into a permanent image.

FIG. 15 is a schematic view of a conventional image-forming apparatus. An image-forming apparatus 26 includes yellow, magenta, cyan, and black image-forming sections 44Y, 44M, 44C, and 44BK. The image-forming sections incorporate photoconductive drums 27Y, 27M, 27C, and 27BK and transfer rollers 34Y, 34M, 34C, 34BK. The photoconductive drums 27Y, 27M, 27C and 27BK oppose corresponding transfer rollers 34Y, 34M, 34C, and 34BK with a transfer belt 33 sandwiched therebetween. A belt-cleaning section 35 is located under the transfer belt 33 and removes toner adhering to the transfer belt 33. The transfer belt 33, transfer rollers 34Y, 34M, 34C, and 34BK, and belt-cleaning section 35 form a transfer section 45.

The image-forming sections 44Y, 44M, 44C, and 44BK will be described. Each of the image-forming sections 44Y, 44M, 44C, and 44BK may be substantially identical; for simplicity only the operation of the image forming section 44BK for forming black images will be described, it being understood that the other image forming sections may work in a similar fashion.

Disposed around the photoconductive drum 27 are a cleaning unit 28, neutralizing lamp 29, a charging roller 30, an exposing unit 31, and a developing roller 32, which are aligned in this order from upstream to downstream with respect to the rotation of the photoconductive drum 27. A transporting mechanism 41 is disposed immediately below the cleaning unit 28 and transports the toner removed by the cleaning unit 28 from the photoconductive drum 27.

A toner discharging path 17 runs along the transfer belt 33 under the image-forming sections 44Y, 44M, 44C, and 44BK. The transporting mechanism 41 transports the waste toner to the toner discharging path 17, so that the waste toner is finally collected into a waste toner reservoir 11.

The operation of the image-forming apparatus 26 of the aforementioned configuration will be described. Paper 40 is advanced from a paper tray 36 into a paper path through which the paper 40 is fed by the transport roller 37 into a gap between the photoconductive drum 27 and the transfer belt 33.

The neutralizing lamp 29 neutralizes residual charges on the surface of the photoconductive drum 27BK of the image-forming section 44BK. The charging roller 30BK uniformly charges the entire cylindrical surfaces of the photoconductive drum 27BK. The exposing unit 31 irradiates the charged surface of the photoconductive drum 27BK with light to form an electrostatic latent image. Then, the developing roller applies toner to the electrostatic latent image to develop the electrostatic latent image into a toner image. The toner image is then transferred onto the paper 40, and then fixed into a permanent image in the fixing unit 38. Then, the paper 40 having a permanent image thereon is ejected onto a stacker 39.

Some of the toner fails to be transferred onto the paper 40 and is left on the photoconductive drum 27BK. The residual toner is removed as waste toner and the waste toner is transported by the transporting mechanism 41. The toner may also adhere to the transfer belt 33 due to poor charging and may be transferred onto the transfer belt during an image-density correcting operation. The toner on the transfer belt is removed by the belt-cleaning section 35 and collected into the waste toner reservoir 11.

The waste toner reservoir 11 will be described. FIG. 16 is a cross-sectional view of a conventional waste toner reservoir 11. FIG. 17 is a cross-sectional view of another conventional waste toner reservoir.

Referring to FIG. 15, a box-like waste toner reservoir 11 is formed with an opening 42 through which the aforementioned toner discharging path 17 extends into the waste toner reservoir 11. The waste toner is removed from the photoconductive drum 27 by the cleaning unit 28 and transported by the transporting mechanism 41 to the toner discharging path 17. A simple sealing member 43 is disposed for providing a sealed environment for the waste toner reservoir 11. The sealing member 43 holds the toner discharging path 17 fitted into the opening 42, thereby improving sealing effect to prevent toner particles from scattering. The opening 42 may be formed in a top portion or a side portion of the waste toner reservoir 11.

With the aforementioned conventional image-forming apparatus 26, if the waste toner reservoir is tilted or subjected to impact during replacement of the waste toner reservoir 11, the toner may fall through the opening 42 impairing the ability of the waste toner reservoir to handle the waste toner.

SUMMARY OF THE INVENTION

The present invention was made to solve the aforementioned problems with the conventional apparatus.

An object of the present invention is to provide a developer reservoir that offers good handleability when the developer reservoir is attached to or detached from an image forming apparatus.

A developer reservoir detachably is attached to an image-forming apparatus and holds developer discharged from a developer discharging section of the image forming apparatus. The developer reservoir includes a developer inlet, a developer chamber, and a developer-transporting member. The developer is received through the developer inlet. The developer chamber holds the developer delivered through the developer inlet. The developer-transporting member transports the developer from the developer inlet into the developer chamber.

The developer-transporting member is received in the developer inlet.

The developer-transporting member serves as a partition that divides the waste toner reservoir into the toner inlet and the toner chamber so that the developer is prevented from moving straight from the developer inlet into the developer chamber.

The developer-transporting member includes a screw formed thereon.

The developer reservoir further includes an enclosure that encloses the screw. The enclosure extends in a longitudinal direction in which the developer-transporting member transports the developer. The enclosure has a dimension in the longitudinal direction longer than a pitch of the screw.

The developer inlet includes a space that holds an amount of the developer before the developer is fed by the transport mechanism into the developer chamber.

The developer reservoir further includes a pressure detector that detects a pressure of the developer held in the toner chamber.

The pressure is detected in terms of a reaction force exerted on the transport mechanism by the developer held in the toner chamber.

The screw is one of a plurality of screws in spaced relation.

An image forming apparatus incorporates the aforementioned developer reservoir. The image forming apparatus includes at least one photoconductor, a charging unit, an exposing unit, a developing unit, a transfer unit, and a fixing unit. The charging unit charges a surface of the photoconductor. The exposing unit illuminates the charged surface of the photoconductor to form an electrostatic latent image in accordance with print data. The developing unit that supplies the developer to the electrostatic latent image on the photoconductor to form a visible image. The transfer unit that transfers the visible image onto a print medium. The fixing unit that fixes the visible image on the print medium into a permanent image.

The image forming apparatus further includes a transporting mechanism, a drive source, and a controller. The transporting mechanism transports the developer from a cleaning unit. The drive source drives the transporting mechanism. The transporting mechanism transports the developer from the developer inlet to the developer chamber. The controller causes the transporting mechanism to stop and thereafter causes the drive section to stop.

The image forming apparatus further includes a drive mechanism, a detector, and a controller. The drive mechanism drives the transport mechanism. The detector outputs a detection signal in accordance with an operation state of the developer-transporting mechanism. The controller causes the drive section to stop in accordance with the detection signal.

The image forming apparatus further includes a drive section and a torque limiter. The drive section drives the transport mechanism. A torque is transmitted from the drive section to the transport mechanism through the torque limiter. The torque is transmitted when the torque is not more than a predetermined value and not transmitted when the torque is more than the predetermined value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{General Construction}

Figure 1:
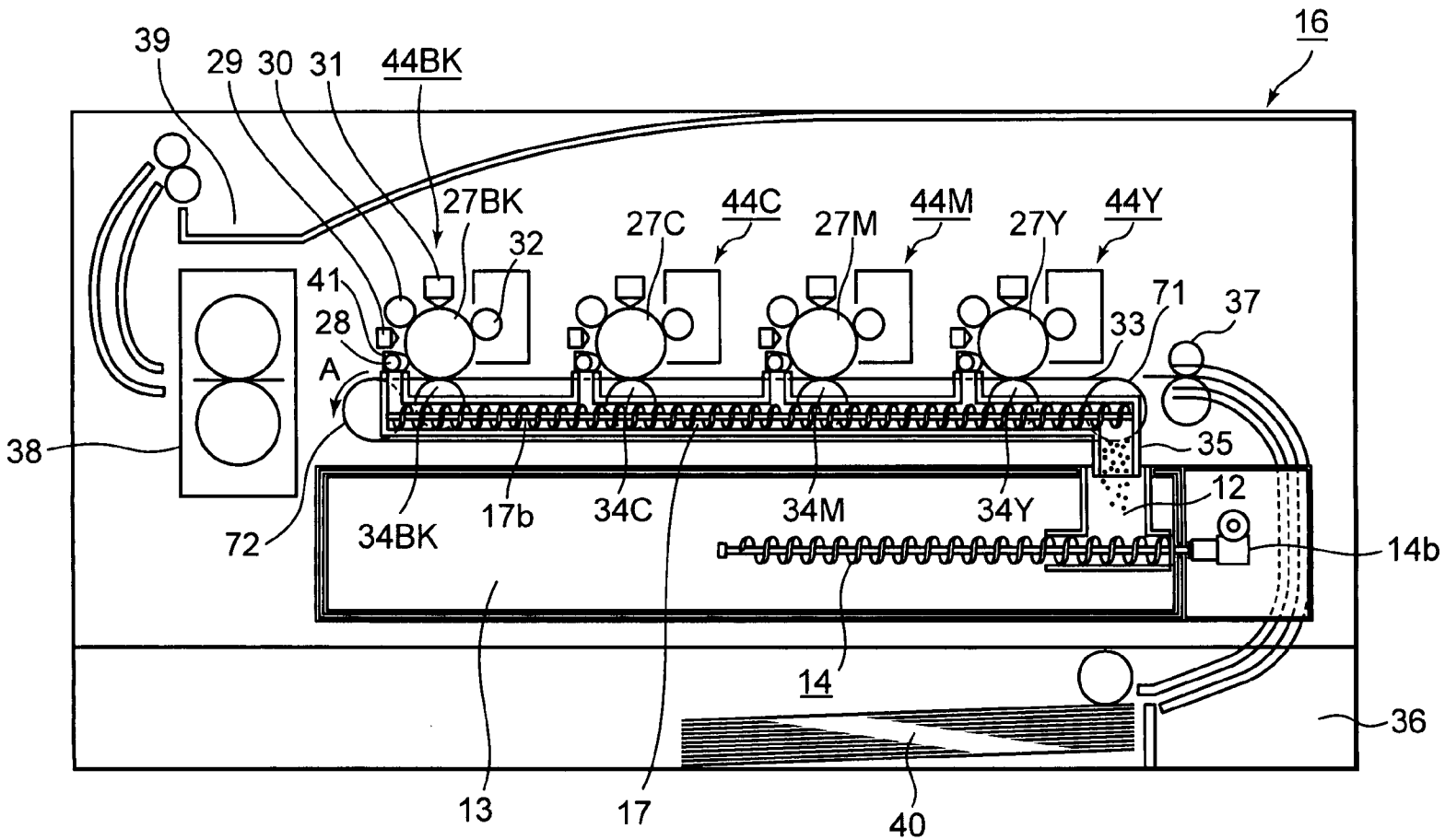
FIG. 1 is a schematic view of an image forming section according to a first embodiment of the invention.

FIG. 1 is a schematic view of an image-forming section according to a first embodiment of the invention.

Referring to FIG. 1, an image-forming apparatus 26 includes image-forming sections 44Y, 44M, 44C, and 44BK for forming yellow, magenta, cyan, and black toner images, respectively. The image-forming sections include photoconductive drums 27Y, 27M, 27C, and 27BK, which oppose corresponding transfer rollers 34Y, 34M, 34C, and 34BK, respectively.

A transfer belt 33 is entrained about a drive roller 71 and a driven roller 72, and runs in a direction shown by arrow A, while also being sandwiched between the transfer rollers 34Y, 34M, 34C, and 34BK and the photoconductive drums 27Y, 27M, 27C, and 27BK. The transfer belt 33 passes through the image-forming sections 44Y, 44M, 44C, and 44BK in this order. A belt cleaning unit 35 is disposed at a convenient location and removes the toner from the transfer belt 33. The transfer belt 33, transfer rollers 34Y, 34M, 34C, and 34BK, and cleaning section 35 form a transfer section 45.

The image forming sections 44Y, 44M, 44C, and 44BK will be described. Each of the image-forming sections 44Y, 44M, 44C, and 44BK may be substantially identical; for simplicity only the operation of the image forming section 44BK for forming black images will be described, it being understood that the other image forming sections may work in a similar fashion.

Disposed around the photoconductive drum 27Bk, for example, are a cleaning unit 28, a neutralizing lamp 29, a charging roller 30, an exposing unit 31, and a developing roller 32, which are aligned in this order from upstream to downstream with respect to the rotation of the photoconductive drum 27. A transporting mechanism 41 is disposed immediately below the cleaning unit 28, and transports the toner removed by the cleaning unit 28 from the photoconductive drum 27.

A toner discharging path 17 runs along the transfer belt 33 under the image forming sections 44Y, 44M, 44C, and 44BK. The transporting mechanism 41 transports the waste toner to the toner discharging path 17, so that the waste toner is finally collected into a waste toner reservoir 11. The waste toner reservoir 11 is removably attached to the image forming apparatus. A spiral screw 17*b* is provided in the toner discharging path 17 and driven in rotation by a drive source, not shown, so as to transport the waste toner to the cleaning unit 35 near the image-forming section 44Y.

The operation of the image forming apparatus 26 of the aforementioned configuration will be described. Paper 40 is advanced from a paper tray 36 into a paper path where the transport roller 37 feeds the paper into a gap between the photoconductive drum 27 and the transfer belt 33.

The neutralizing lamp 29 neutralizes residual charges on the surface of the photoconductive drum 27BK of the image-forming section 44BK. The charging roller 30BK uniformly charges the entire cylindrical surface of the photoconductive drum 27BK. The exposing unit 31 irradiates the charged surface of the photoconductive drum 27BK with light to form an electrostatic latent image. Then, the developing roller 32 applies the toner to the electrostatic latent image to develop the electrostatic latent image into a toner image. The toner image is then transferred onto the paper 40 and fixed into a permanent image in the fixing unit 38. Then, the paper 40 having a permanent image thereon is ejected onto a stacker 39.

Some of the toner fails to be transferred onto the paper 40, and is left on the photoconductive drum 27BK. The cleaning unit 28 removes the residual toner as waste toner and the transport mechanism 41 transports the waste toner. The waste toner may adhere to the transfer belt 33 due to poor charging and may be transferred onto the transfer belt 33 during an image-density correcting operation. The toner on the transfer belt 33 is removed by the belt cleaning section 35 and collected into the waste toner reservoir 11.

Figure 2:
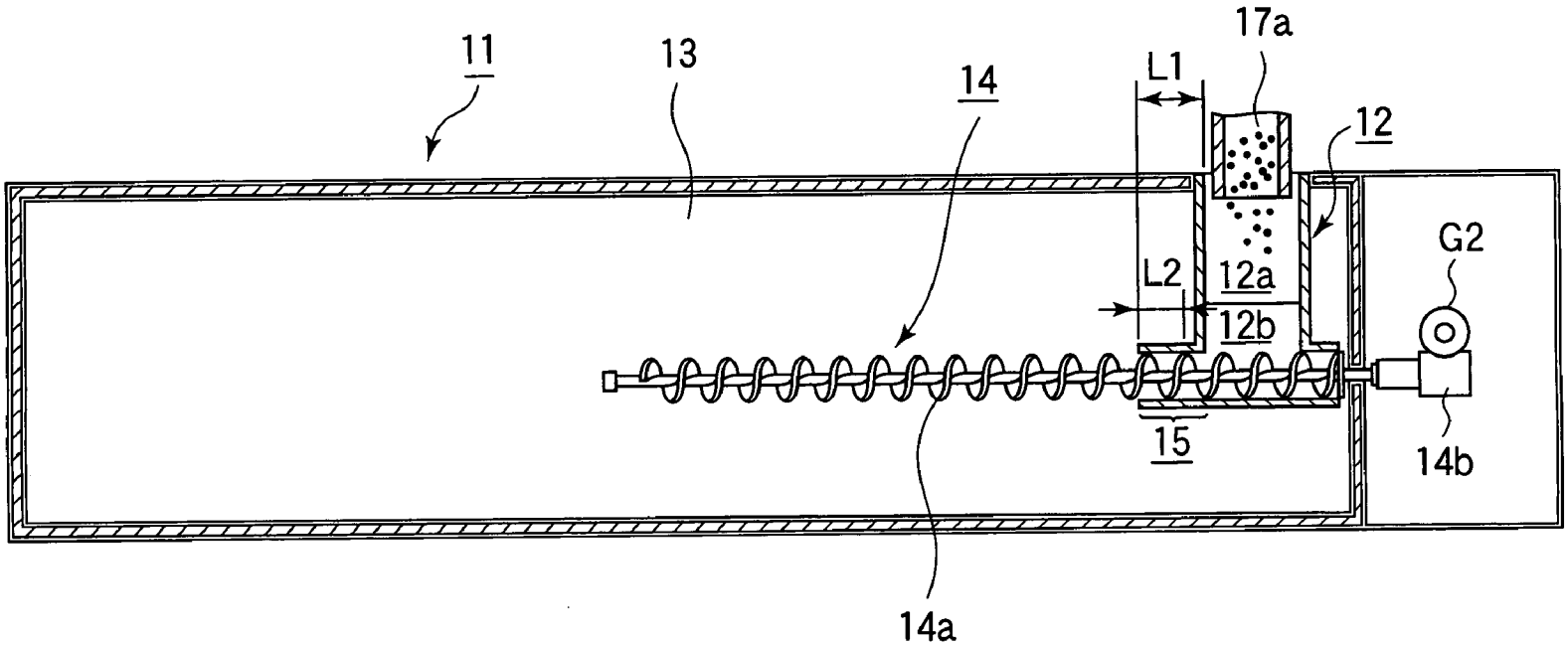
FIG. 2 is a cross-sectional view of a toner reservoir.

FIG. 2 is a cross-sectional view of a toner reservoir. The waste toner reservoir 11 will now be described. Referring to FIG. 2, a toner discharging path 17 is formed with an opening 17*a* at its longitudinal end portion. The waste toner is removed by the cleaning unit 35 and collected into the toner discharging path 17. Then, the waste toner is introduced into the waste toner reservoir 11 through the opening 17*a*.

The waste toner reservoir 11 includes a toner chamber 13 and a toner inlet 12 that extends into the toner chamber 13. The toner inlet 12 is in line with the opening 17*a* so that the waste toner falls from the opening 17*a* into the toner inlet 12. A transport mechanism 14 is provided at a lower end of the toner inlet 12. The transport mechanism 14 includes a spiral blade or screw 14*a* that transports the waste toner from the toner inlet 12 into the toner chamber 13. The screw 14*a* serves as a partition that divides the waste toner reservoir 11 into the toner inlet 12 and the toner chamber 13. The waste toner reservoir 11 includes two chassis 11*a* and 11*b* that are assembled together with a sealing member S (FIG. 6) therebetween.

The toner inlet 12 includes a hollow cylinder having a rectangular cross section 12*a* that extends vertically and a hollow guide 12*b* that communicates with the cylinder 12*a* and extends in a downward direction transverse to the vertically extending hollow cylinder 12*a*. While the hollow cylinder 12*a* extends straight vertically, it may extend in a downward direction just as the hollow guide 12*b*. The hollow cylinder 12*a* has a space sufficient to hold a prescribed amount of waste toner. The rectangular hollow guide 12*b* has an open end portion 15 that loosely receives the screw 14*a*. The open end portion 15 has a length L1 longer than a pitch L2 of the screw 14*a* so that the waste toner in the toner chamber 13 is difficult to enter the toner inlet 12.

Figure 3:
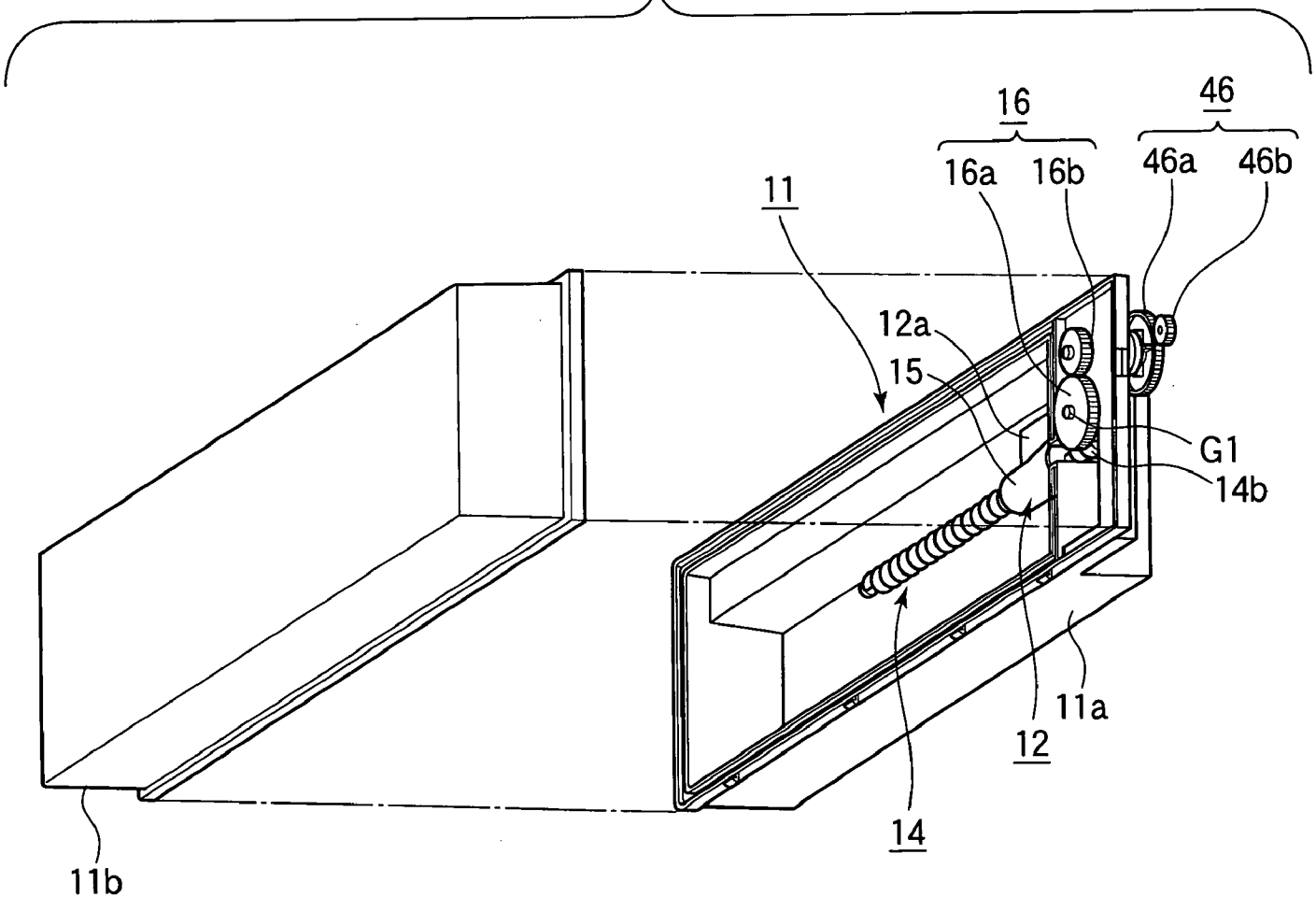
FIG. 3 is a perspective view of the toner reservoir.

FIG. 3 is a perspective view of the toner reservoir 11. A drive mechanism for the transport mechanism 14 will be described. Referring to FIG. 3, a gear train 16 is disposed inside of the waste toner reservoir 11 and drives the transport mechanism 14 in rotation. A gear train 46 is disposed on the image forming apparatus 26 side. The gear train 16 includes a gear 16*a* and a gear 16*b*. The gear train 46 includes a gear 46*a* and a gear 46*b*. The gear 16*b* and the gear 46*a* are coupled via a coupling mechanism, thereby transmitting a drive force from the gear train 46 to the gear train 16.

The gear 16*a* is in meshing engagement with a gear 14*b* that is molded in one piece with the transport mechanism 14. The gear 16*a* includes a large gear G1 and a small gear G2. The small gear G2 takes the form of a worm so that the small gear G2 and the gear 14*b* form a worm-gear mechanism.

Figure 4:
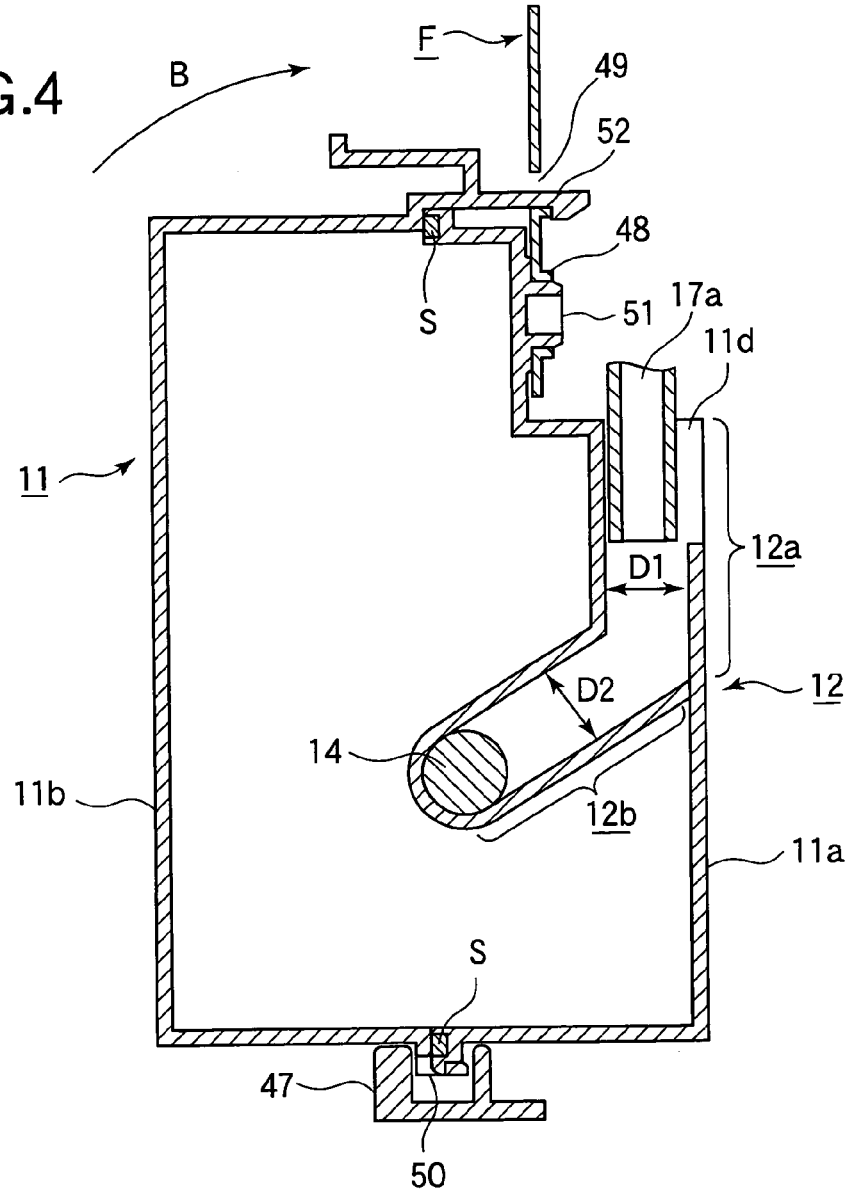
FIG. 4 is a cross-sectional view illustrating the toner reservoir when it is attached to an image forming apparatus.

FIG. 4 is a cross-sectional view of the waste toner reservoir 11 when it is attached to an image forming apparatus. A description will be given of the mounting of the waste toner reservoir 11 to a frame F of the image forming apparatus. Referring to FIG. 4, the frame F of the image-forming apparatus 26 includes a lower guide 47, a guide hole 48, and a locking hole 49. The lower guide 47 is disposed under the bottom of the waste toner reservoir 11 and extends in a longitudinal direction of the waste toner reservoir 11. The guide hole 48 is formed in the frame F near an upper side portion of the waste toner reservoir 11. The locking hole 49 is formed in the frame F near the top portion of the waste toner reservoir 11. A hook 50 is formed on the waste toner reservoir 11 and engages the lower guide 47. A guide post 51 is provided above the toner inlet 12. A locking hook 52 is formed on the top of the waste toner reservoir 11.

When the waste toner reservoir 11 is mounted to the frame F of the image-forming apparatus, the hook 50 is brought into engagement with the lower guide 47. Then, the waste toner reservoir 11 is rotated about the hook 50 toward the frame F in a direction shown by arrow B until the guide post 51 fits into the guide hole 48, thereby positioning the waste toner reservoir 11. At this moment, the locking hook 52 is brought into locking engagement with the locking hole 49, and the gears 46*a* moves into meshing engagement with the gear 16*b*.

In this manner, the waste toner reservoir 11 is positioned in place in the image-forming apparatus. Referring to FIG. 4, the toner inlet 12 includes a hollow cylinder 12*a* having a rectangular cross section that extends vertically and a hollow guide 12*b* having a rectangular cross section that communicates with the hollow cylinder 12*a* and extends in a downward direction transverse to the vertically extending hollow cylinder 12*a*. The hollow cylinder 12*a* has a space sufficient to hold a prescribed amount of waste toner. The hollow cylinder 12*a* and hollow guide 12*b* have a dimension D1 and a dimension D2, respectively, that are substantially the same as the diameter of the screw 14*a*.

When a toner receiving motor, not shown, rotates, the gear 46*b* drives the gear 16*a* to rotate. The gear 16*a* in turn drives the gear 16*b*. Thus, the gear 16*b* also rotates. The rotation of the gear 16*a* causes the transport mechanism 14 to rotate, thereby forcibly moving the waste toner received through the toner inlet 12 into the toner chamber 13. Because the screw 14*a* of the transport mechanism 14 effectively compresses the waste toner held in the toner chamber 13, a relatively small volume of the toner chamber 13 still holds a relatively large amount of waste toner.

The toner inlet 12 is made integral with the chassis 11*a* and extends into the waste toner reservoir 11. This configuration is effective in preventing the waste toner from scattering from the toner inlet 12 and in simplifying the sealing structure that provides a sealed environment for the waste toner reservoir 11.

Because the open end portion 15 is longer than the pitch L2 of the screw 14*a*, it is difficult for the waste toner in the toner chamber 13 to enter the toner inlet 12 straight. Therefore, even if the waste toner reservoir 11 is tilted for a short time or subjected to impact during replacement of the waste toner reservoir 11, the toner does not fall through the opening 11*d* improving the ability of the waste toner reservoir to handle waste toner.

The operation of a controller will be described.

Figure 5:
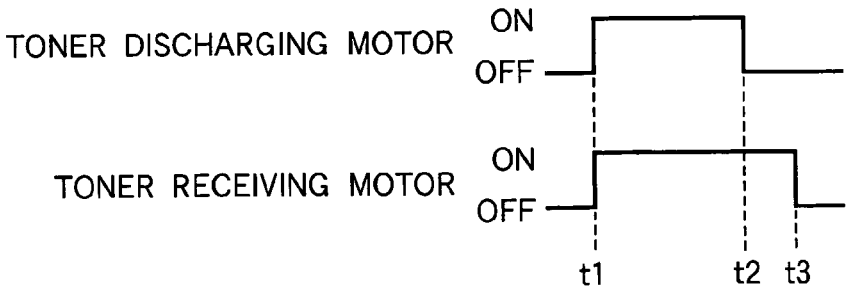
FIG. 5 is a timing chart illustrating the operation of the controller according to the first embodiment.

FIG. 5 is a timing chart illustrating the operation of the controller according to the first embodiment. At timing t1, the controller, not shown, performs a drive operation in which a toner receiving motor and a toner discharging motor are driven into rotation, so that the toner transporting mechanism 41 starts to transport through the toner discharging path 17 (FIG. 1) and the transport mechanism 14 starts to receive the waste toner into the toner chamber 13. The waste toner received through the toner inlet 12 is immediately delivered into the waste toner chamber 13. At timing t2, the controller stops the toner discharging motor and therefore the discharging of the waste toner through the toner discharging path 17 is stopped. However, some toner may be left in the toner inlet 12 at this moment. Thus, the controller controls the toner receiving motor to continue to rotate for a short time after the toner discharging motor has stopped. The toner receiving motor stops at timing t3. The time length from the timing t2 to the timing t3 is selected to be longer than the time required for all the waste toner in the toner inlet 12 to be collected into the toner chamber 13.

In this manner, the toner receiving motor continues to rotate until the waste toner in the toner inlet 12 is completely discharged into the toner chamber 13. This prevents the waste toner in the toner inlet 12 from falling through an opening 11*d* (FIG. 4) improving the ability of the waste toner reservoir 11 to handle waste toner.

In other words, the waste toner reservoir 11 is designed such that the waste toner reservoir 11 cannot disengage from the frame F of the image-forming apparatus until the waste toner in the toner inlet 12 is completely discharged into the toner chamber 13. Therefore, even if the waste toner reservoir 11 is tilted for a short time or subjected to impact during replacement, the waste toner is prevented from leaking or spilling from the waste toner reservoir 11.

Second Embodiment

Elements similar to those in the first embodiment have been given the same reference numerals and the description thereof is omitted.

Figure 6:
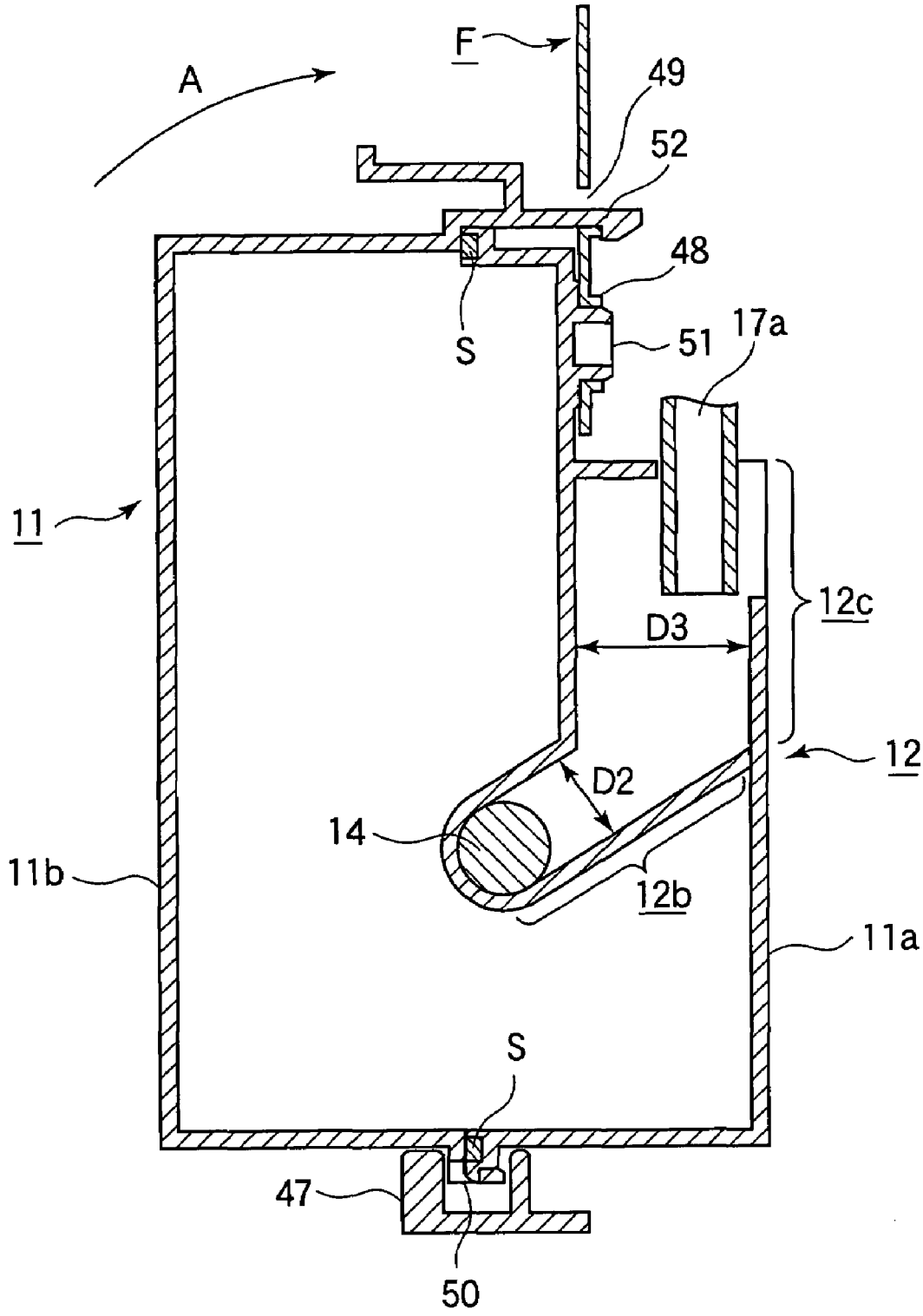
FIG. 6 illustrates a waste toner reservoir according to a second embodiment when it is attached to a frame of an image forming apparatus.

FIG. 6 illustrates a waste toner reservoir 11 according to a second embodiment when it is attached to a frame F of an image forming apparatus. The toner inlet 12 includes a hollow cylinder 12*c* that has a rectangular cross section and extends vertically, a hollow guide 12*b* that communicates with the cylinder 12*a* and extends in a downward direction transverse to the vertically extending hollow cylinder 12*a*. The hollow cylinder 12*a* has a space sufficient to hold a prescribed amount of waste toner. The hollow guide 12*b* has an open end portion 15 that loosely receives the screw 14*a*.

The hollow cylinder 12*c* has a volume large enough to hold a large amount of waste toner temporarily so that the hollow cylinder 12*c* can serve as a buffer.

Thus, the hollow cylinder 12*c* has an inner width D3 that is at least 1.5 times a diameter of the screw 14*a*. Thus, even if a large amount of waste toner enters the hollow cylinder 12*c*, the waste toner does not overflow.

While the hollow cylinder 12*c* extends straight vertically, it may be extends in a downward direction just as the hollow guide 12*b*.

Third Embodiment

Figure 7:
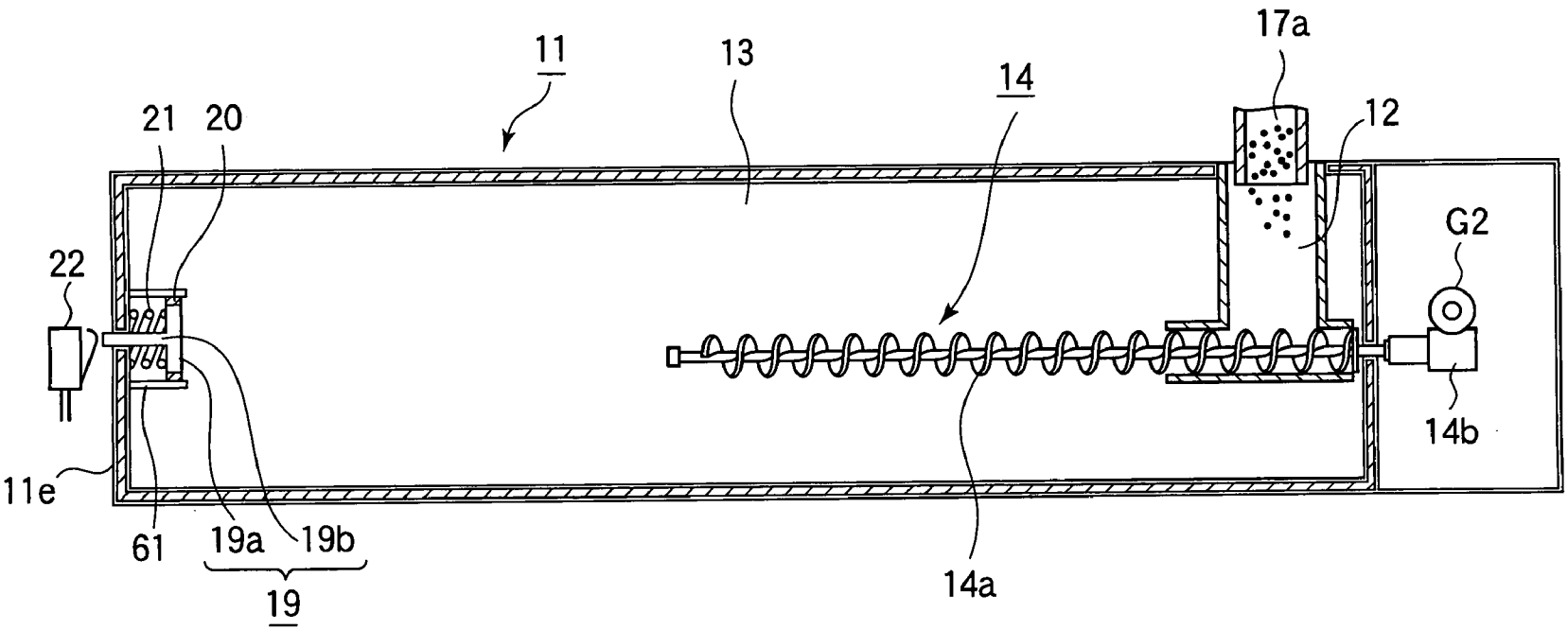
FIG. 7 is a cross-sectional view of a waste toner reservoir according to a third embodiment.

Elements similar to those of the first and second embodiments have been given the same reference numerals and the description thereof is omitted. FIG. 7 is a cross-sectional view of a waste toner reservoir 11 according to a third embodiment. Referring to FIG. 7, a waste toner reservoir 11 extends in a longitudinal direction. The waste toner reservoir 11 has a toner inlet 12 at one longitudinal end portion and a toner detector 19 at another longitudinal end portion. A hollow cylinder 61 projects from a wall 11*e* toward the middle portion of the waste toner reservoir 11. The toner detector 19 includes a pressure sensing portion 19*a* and a projection 19*b*. A coil spring 21 and the toner detector 19 are received in the hollow cylinder 61 such that the projection 19*b* extends through the spring 21 and the wall 11*e* and is slidable in the hollow cylinder 61. The pressure sensing portion 19*a* has a sealing member 20 disposed between the pressure sensing portion 19*a* and the inner wall of the hollow cylinder 61, the sealing member providing a seal against the waste toner. The sealing member 20 is formed of an elastic material such as sponge or felt and prevents the waste toner from leaking to the outside of the waste toner reservoir 11.

As the amount of waste toner in the toner chamber 13 increases, the pressure of the waste toner exerts a larger force on the pressure sensing portion 19*a* against the urging force of the spring 21. Thus, the projection 19*b* extends further through the wall 11*e*. When the force exceeds a predetermined value, the projection 19*b* finally pushes a lever of a sensor switch 22 mounted on the image forming apparatus side. When the sensor switch is turned on, the sensor switch provides a detection signal to the controller. In response to the detection signal, the controller causes a display to indicate to the operator that the amount of waste toner in the toner chamber 13 has exceeded a predetermined level and should be discarded.

As described above, the third embodiment is capable of detecting when the toner chamber 13 becomes full of waste toner and therefore improves the ability of the toner reservoir 11 to handle waste toner.

Fourth Embodiment

Elements similar to those of the first to third embodiments have been given the same reference numerals and the description thereof is omitted.

Figure 8:
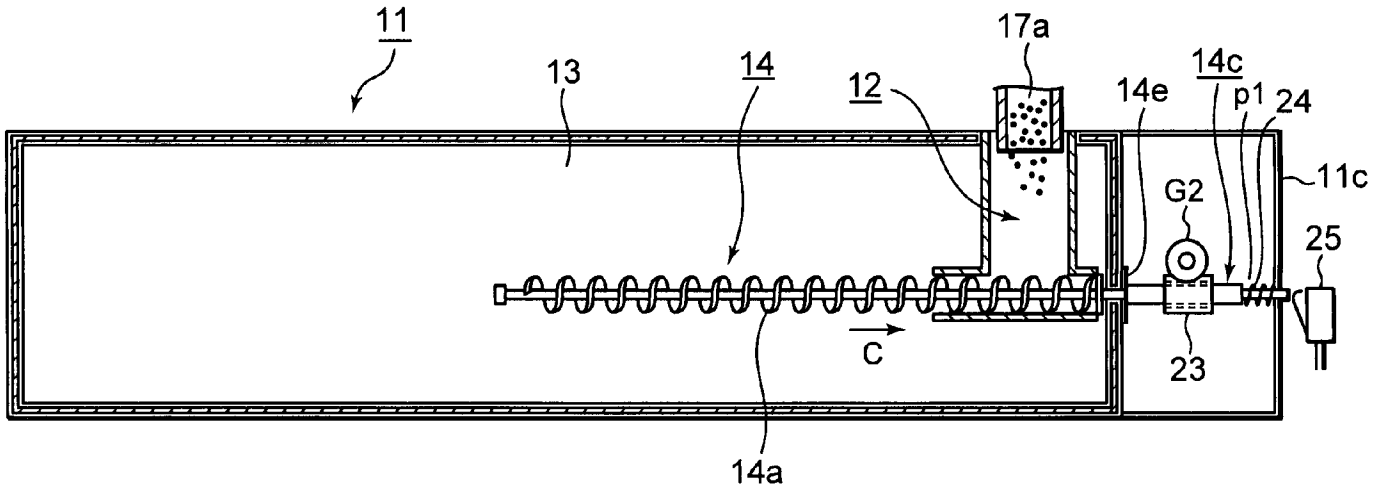
FIG. 8 is a cross-sectional view of a waste toner reservoir according to a fourth embodiment.
Figure 9:
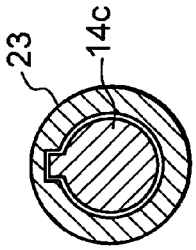
FIG. 9 illustrates a gear that engages a shaft of a transport mechanism.

FIG. 8 is a cross-sectional view of a waste toner reservoir 11 according to a fourth embodiment. FIG. 9 illustrates a gear 23 that engages a shaft 14*c* of a transport mechanism 14.

Referring to FIG. 9, the transport mechanism 14 has a shaft 14*c* on which a gear 23 is mounted. The gear 23 is movable relative to the shaft 14*c* in a longitudinal direction of the shaft 14*c* but rotatable together with the shaft 14*c*. The small gear G2 takes the form of a worm so that the small gear G2 and the gear 23 form a worm-gear mechanism. It is to be noted that the gear 23 is maintained by a mechanism, not shown, in meshing engagement with the small gear. Referring to FIG. 8, The shaft 14*c* has a small diameter portion P1 that extends through a coil spring 24 so that the coil spring 24 is mounted between a wall 11*c* of the waste toner reservoir 11 and the large diameter portion of the shaft 14*c*. A free end portion of the small diameter portion P1 extends through the wall 11*c* to oppose a sensor switch 25 provided outside of the waste toner reservoir 11.

The shaft 14*c* has a stopper 14*e* that limits the movement of the transport mechanism 14 toward the toner chamber 13.

As the amount of waste toner in the toner chamber 13 increases, the pressure of the waste toner increases. Thus, the waste toner exerts a reaction force on the screw 14*a* of the transport mechanism 14. When waste toner in the toner chamber 13 exceeds a predetermined amount, the transport mechanism 14 starts to move in a direction shown by arrow C. As the pressure increases further, the gear moves in the C direction little by little. When the pressure exceeds the urging force of the coil spring 24, the transport mechanism 14 is moved sufficiently in the C direction so that the free end of the small diameter portion P1 pushes the sensor switch 25. Thus, the sensor switch 25 becomes on, providing a detection signal to the controller. In response to the detection signal, the controller causes a display to indicate to the operator that the amount of waste toner in the toner chamber 13 has exceeded a predetermined level and should be discarded.

As described above, the fourth embodiment detects that the toner chamber is full of waste toner, thereby improving the handleability of the waste toner reservoir 11.

Fifth Embodiment

In the aforementioned embodiments, the transport mechanism 14 has the screw 14*a*. Therefore, as the transport mechanism rotates, the waste toner in the toner chamber 13 increases in density. As a result, the density becomes high in the vicinity of the screw 14*a* and remains low in areas away from the screw 14*a*, so that the waste toner is not uniform in density within the toner chamber 13.

A fifth embodiment allows the waste toner in the toner chamber to be uniform in density. Elements similar to those of the first embodiment have been given the same reference numerals and the description thereof is omitted.

Figure 10:
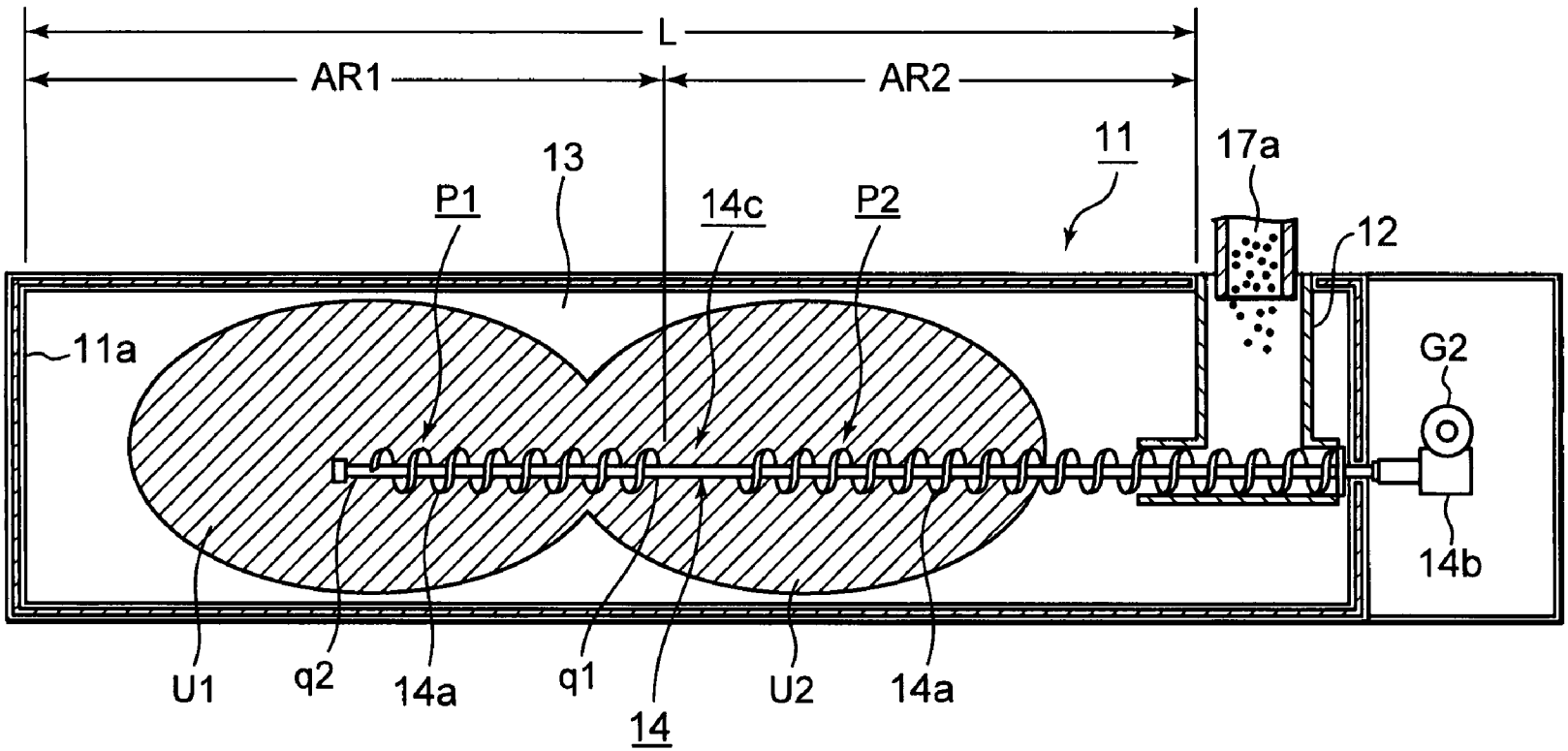
FIG. 10 is a cross sectional view of a waste toner reservoir according to the fifth embodiment.

FIG. 10 is a cross sectional view of a waste toner reservoir 11 according to the fifth embodiment. Referring to FIG. 10, a transport mechanism 14 extends in a longitudinal direction of the waste toner reservoir 11 and has a screw P1 and a screw P2. The screws P1 and P2 are formed on the shaft 14*c* and spaced apart. The screw P1 is downstream of the screw P2 with respect to the direction of movement of the waste toner in the toner chamber 13. The screw P1 has an upstream end q1 located at a mid point of the length L between a toner inlet 12 and a wall 11*a* at a longitudinal end of the toner chamber 13, and extends toward a downstream end. In other words, the upstream end q1 is at a boundary of regions AR1 and AR2 defined by dividing the length L by the number of screws, i.e., 2. The downstream end q2 (free end) of the screw P1 is at essentially the middle of the region AR1.

Likewise, if the transport mechanism 14 has first, second, and third screws, not shown, the first screw is most downstream, the third screw is most upstream, and the second screw is between the first screw and the third screw. The total length L of the toner chamber 13 would be divided by the number of screws, i.e., 3, into regions AR1, AR2, and a third region (not shown), which are aligned in this order from downstream to upstream.

As described above, the transport mechanism 14 according to the fifth embodiment has two screws P1 and P2 located in regions AR1 and AR2, respectively. This arrangement allows waste toner to be dispersed in two high-density regions U1 and U2, thereby accomplishing a relatively uniform profile of density distribution of waste toner over as large an area as possible in the toner chamber 13.

Sixth Embodiment

Elements similar to those of the first embodiment have been given the same reference numerals and the description thereof is omitted.

Figure 11:
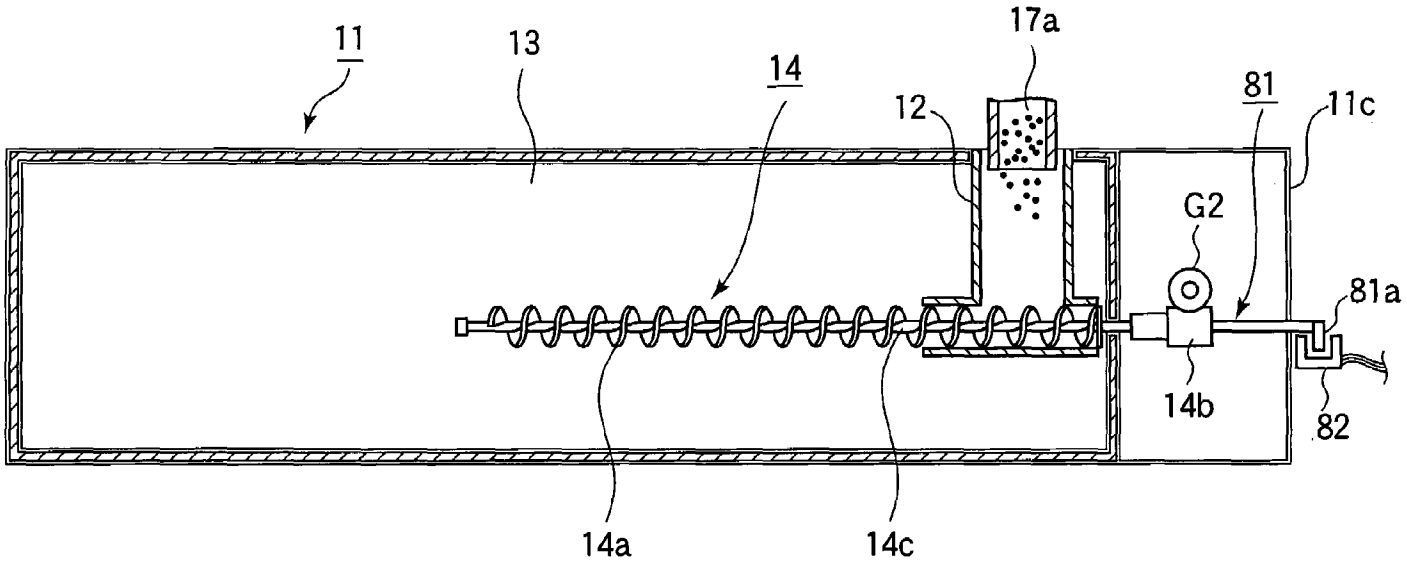
FIG. 11 is a cross-sectional view of a waste toner reservoir according to a sixth embodiment.
Figure 12:
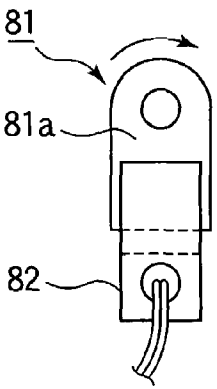
FIG. 12 illustrates a toner detector according to the sixth embodiment.

FIG. 11 is a cross-sectional view of a waste toner reservoir 11 according to a sixth embodiment. FIG. 12 illustrates a toner detector according to the sixth embodiment.

Referring to FIG. 11, a transport mechanism 14 has an actuator 81 that projects in a direction away from a screw 14 formed on a shaft 14*c*. The actuator 81 has a free end portion extending through a longitudinal end wall 11*c* of the waste toner reservoir 11. The free end has an interruption member 81*a* attached to it. A sensor 82 takes the form of a photo interrupter or a hall-effect element, and is disposed outside of the longitudinal end wall 11*c*. When the transport mechanism 14 rotates, the interruption member 81*a* enters and leaves the sensor 82 in a cyclic manner so that the sensor 82 outputs an on-off signal. If the sensor 82 is a photo interrupter, the interruption member 81*a* enters and leaves the path of light of the sensor 82 in a cyclic manner. If the sensor 82 is a hall-effect element, the interruption member 81*a* is, for example, a magnet that moves close to and away from the hall effect element in a cyclic manner.

When a toner receiving motor stops, the transport mechanism 14 stops rotating. When the toner pressure in a toner chamber 13 increases to an abnormal level to exert an excessive load on the transport mechanism 14, the transport mechanism 14 stops rotating. When the transport mechanism 14 stops rotating, the sensor 82 stops outputting the on-off signal. When the sensor 82 does not output the on-off signal, the controller determines that an abnormal condition occurred with the toner receiving motor or the transport mechanism 14. Then, the controller causes the toner discharging motor to stop, thereby stopping discharging the waste toner.

This configuration prevents the waste toner from being discharged into a toner inlet 12 when the transport mechanism 14 is not rotating. Therefore, the waste toner in the toner inlet 12 does not overflow.

Seventh Embodiment

Elements similar to those of the sixth embodiment have been given the same reference numerals and the description thereof is omitted.

Figure 13:
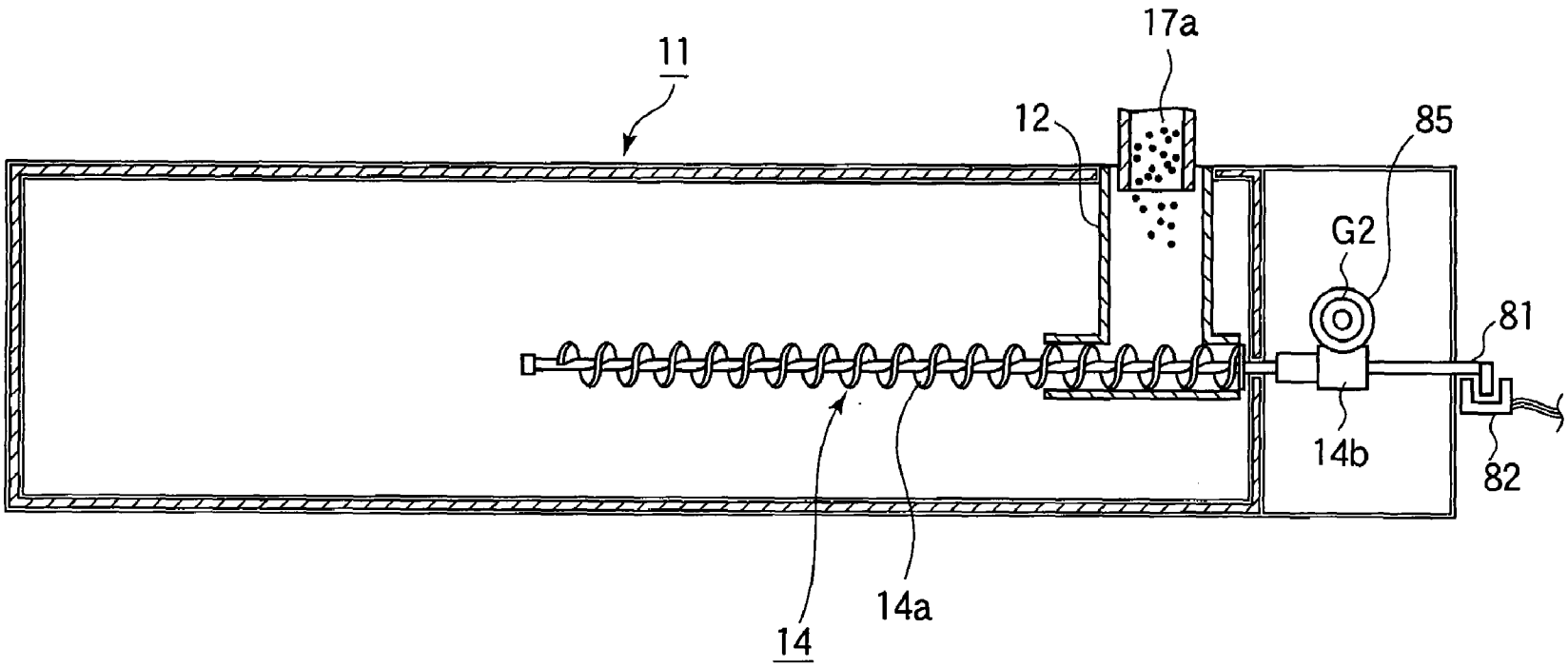
FIG. 13 is a cross-sectional view of a waste toner reservoir according to a seventh embodiment.
Figure 14:
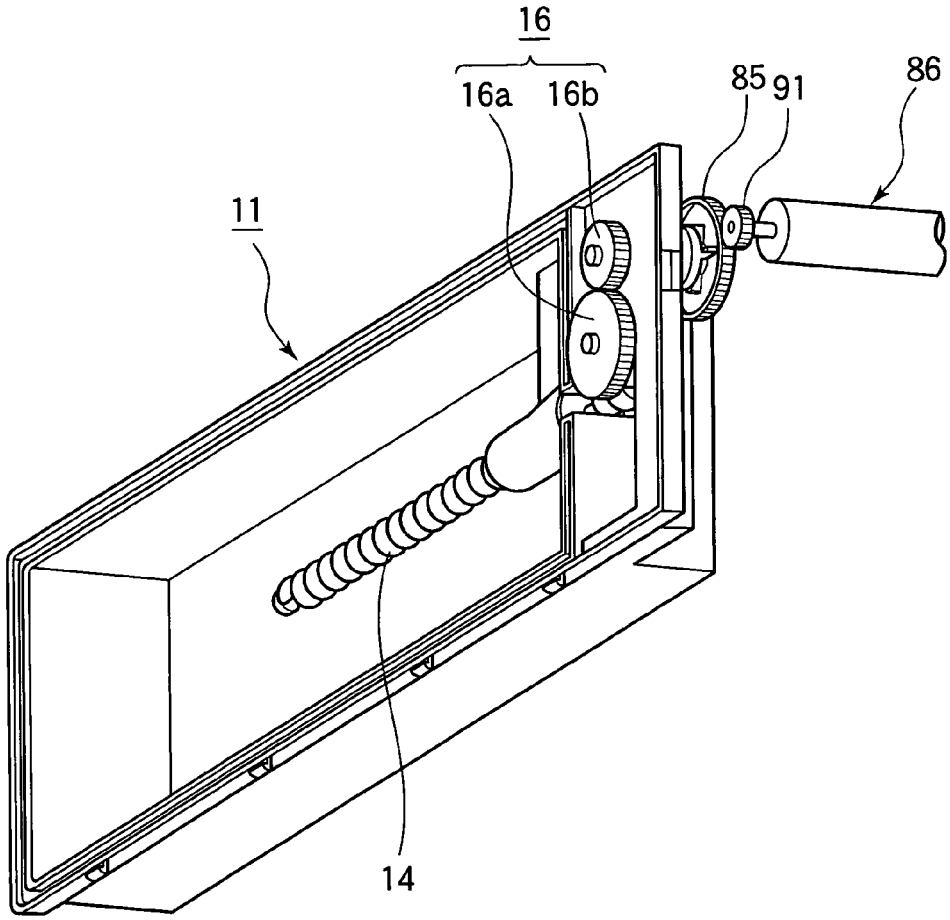
FIG. 14 is a perspective view illustrating a gear train mounted to the waste toner reservoir.
Figure 15:
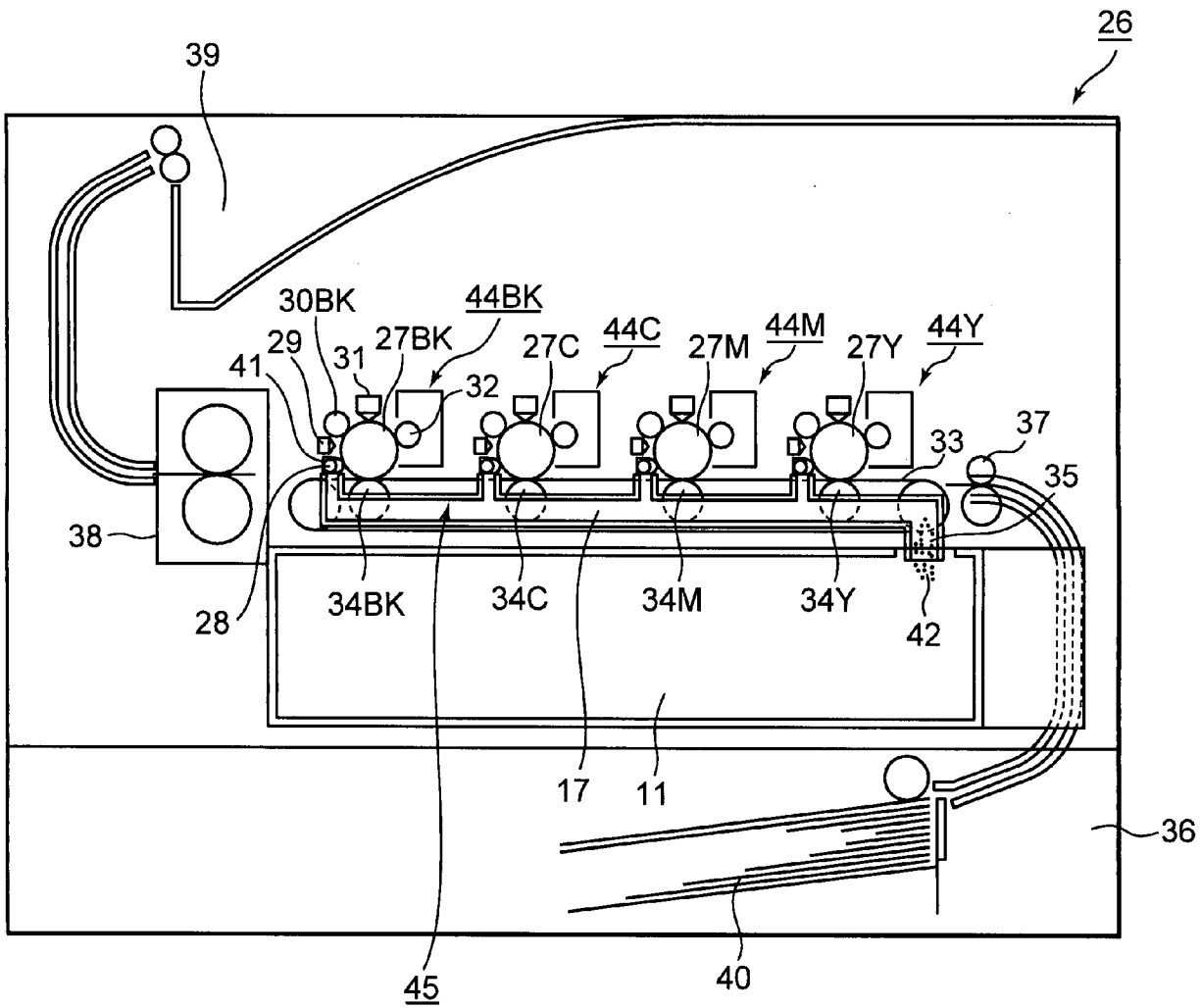
FIG. 15 CONVENTIONAL ART
FIG. 15 is a schematic view of a conventional image forming apparatus.
Figure 16:
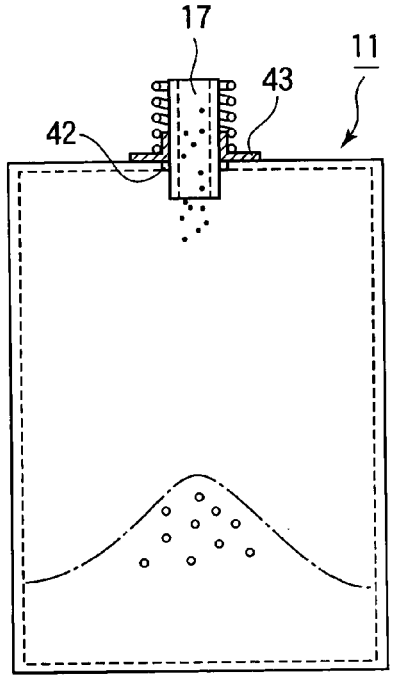
FIG.16 CONVENTIONAL ART
FIG. 16 is a cross-sectional view of a conventional waste toner reservoir.
Figure 17:
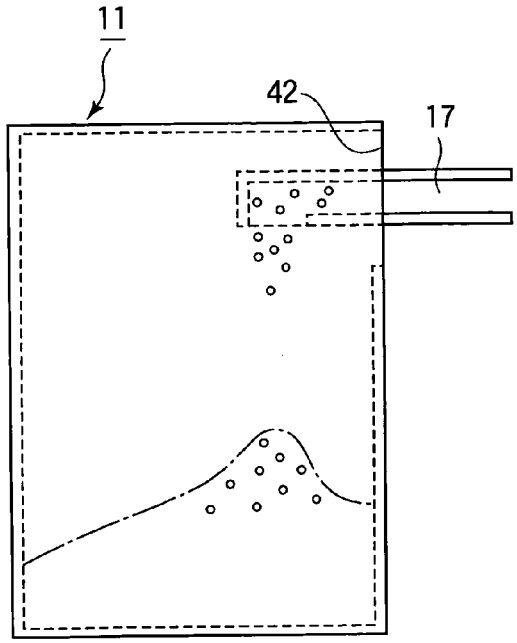
FIG.17 CONVENTIONAL ART
FIG. 17 is a cross-sectional view of another conventional waste toner reservoir.

FIG. 13 is a cross-sectional view of a waste toner reservoir 11 according to a seventh embodiment. FIG. 14 is a perspective view illustrating a gear train mounted to the waste toner reservoir 11.

An image forming apparatus incorporates a medium-transporting motor that transports paper 40 (FIG. 1). In the seventh embodiment, the medium-transporting motor also serves as a toner receiving motor. A transport roller 86 is disposed on the image forming apparatus 26 side and transports the paper 40 for printing.

When the medium-transporting motor rotates, the rotation of the medium-transporting motor is transmitted to the transport roller 86. A gear 91 is attached to one end of the transport roller 86. The gear 91 is in meshing engagement with a torque limiter 85, so that the rotation of the transport roller 86 is transmitted to a gear train 16 through the torque limiter 85. The torque limiter 85 is such that when the torque limiter 85 receives a torque load exceeding a predetermined value, the torque limiter 85 does not transmit rotation and turns free.

As the amount of waste toner in the toner chamber increases, the pressure of the waste toner increases. The increased pressure of the waste toner exerts a reaction force on the screw 14*a*. When the pressure of the waste toner in a toner chamber 13 increases to an abnormal level to exert an excessive load on the transport mechanism 14, a torque load in excess of a predetermined value is exerted on the gear train 16. Thus, the torque limiter 85 turns free so that the transport mechanism 14 stops. When the transport mechanism 14 stops rotating, the sensor 82 does not output the on-off signal. When the sensor 82 does not output the on-off signal, the controller determines that an abnormal condition occurred with the transport mechanism 14. Then, the controller causes the toner discharging motor to stop, thereby stopping discharging the waste toner.

Because the torque limiter 85 continues to rotate after a torque load in excess of a predetermined value is exerted on the gear train 16, the paper 40 continues to be transported. This prevents an excess load from being exerted on the medium-transporting motor, improving durability of the medium-transporting motor.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer reservoir detachably attached to an image-forming apparatus and holding developer discharged from a developer discharging section of the image forming apparatus, the developer reservoir comprising:

a first chamber that holds the developer;

a second chamber that includes a developer inlet through which the developer is received from an external device, and a portion that extends downwardly into an inner space of said first chamber, said second chamber holding an amount of the developer temporarily therein; and a developer-transporting member that transports the developer from said portion of said second chamber into said first chamber.

2. The developer reservoir according to claim 1, wherein said developer-transporting member is received in said portion.

3. The developer reservoir according to claim 1, wherein said developer-transporting member includes a screw.

4. The developer reservoir according to claim 3, wherein said second chamber includes an enclosure that encloses the screw; wherein the enclosure extends in a direction in which said developer-transporting member transports the developer, and has a dimension in said direction longer than a pitch of said screw.

5. The developer reservoir according to claim 3, wherein the screw is divided into a plurality of sections in spaced relation.

6. The developer reservoir according to claim 1, further comprising a pressure detector that detects a pressure of the developer held in said first chamber.

7. The developer reservoir according to claim 6, wherein the pressure is detected in terms of a reaction force exerted on said developer-transporting member by the developer held in said first chamber.

8. An image forming apparatus incorporating the developer reservoir according to claim 1, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies the developer to the electrostatic latent image on said photoconductor to form a visible image;

a transfer unit that transfers the visible image onto a print medium; and a fixing unit that fixes the visible image on the print medium into a permanent image.

9. An image forming apparatus incorporating the developer reservoir according to claim 2, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies developer to the electrostatic latent image on said photoconductor to form a visible image;

a transfer unit that transfers the visible image onto a print medium; and a fixing unit that fixes the visible image on the print medium into a permanent image.

10. An image forming apparatus incorporating the developer reservoir according to claim 3, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies developer to the electrostatic latent image on said photoconductor to form a visible image;

a transfer unit that transfers the visible image onto a print medium; and a fixing unit that fixes the visible image on the print medium into a permanent image.

11. An image forming apparatus incorporating the developer reservoir according to claim 4, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies developer to the electrostatic latent image on said photoconductor to form a visible image;

a transfer unit that transfers the visible image onto a print medium; and a fixing unit that fixes the visible image on the print medium into a permanent image.

12. An image forming apparatus incorporating the developer reservoir according to claim 5, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies developer to the electrostatic latent image on said photoconductor to form a visible image;

a transfer unit that transfers the visible image onto a print medium; and a fixing unit that fixes the visible image on the print medium into a permanent image.

13. An image forming apparatus incorporating the developer reservoir according to claim 6, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies developer to the electrostatic latent image on said photoconductor to form a visible image;

a transfer unit that transfers the visible image onto a print medium; and a fixing unit that fixes the visible image on the print medium into a permanent image.

14. An image forming apparatus incorporating the developer reservoir according to claim 7, wherein the image forming apparatus includes:

at least one photoconductor;

a charging unit that charges a surface of said photoconductor;

an exposing unit that illuminates the charged surface of said photoconductor to form an electrostatic latent image in accordance with print data;

a developing unit that supplies developer to the electrostatic latent image on said photoconductor to form a visible image;

a transfer unit that transfers the visible image onto a print medium; and a fixing unit that fixes the visible image on the print medium into a permanent image.

15. The image forming apparatus according to claim 8, further comprising:

a discharging mechanism that discharges the developer from the developer discharging section;

a first drive section that drives said discharging mechanism;

a second drive section that drives said developer-transporting member; and a controller that causes said discharging mechanism to stop and thereafter causes said developer-transporting member to stop.

16. The image forming apparatus according to claim 8, further comprising:

a drive section that drives said developer-transporting member;

a detector that outputs a detection signal in accordance with an operation state of said developer-transporting member; and a controller that causes said drive section to stop in accordance with the detection signal.

17. The image forming apparatus according to claim 8, further comprising:

a drive section that drives said developer-transporting member;

a torque limiter via which a torque is transmitted from said drive section to said developer-transporting member, the torque being transmitted when the torque is not more than a predetermined value and not being transmitted when the torque is more than the predetermined value.

* * * * *